United States Patent [19]

Phillips et al.

[11] 4,126,398

[45] Nov. 21, 1978

[54] FOUNDRY MIXER SYSTEM WITH GAS ASSISTED RESIN INJECTION

[75] Inventors: David L. Phillips, Fridley; Sherman U. Moxness, Golden Valley; Robert D. Emery, Minneapolis, all of Minn.

[73] Assignee: Bepex Corporation, Santa Rosa, Calif.

[21] Appl. No.: 540,877

[22] Filed: Jan. 14, 1975

Related U.S. Application Data

[63] Continuation-in-part of Ser. No. 337,564, Mar. 2, 1973, abandoned.

[51] Int. Cl.[2] ..... B01F 7/04; B01F 15/02

[52] U.S. Cl. ..... 366/76; 366/99; 366/168; 366/330

[58] Field of Search ..... 259/10, 148, 151, 157

[56] References Cited

U.S. PATENT DOCUMENTS

| | | | |
|---|---|---|---|
| 1,649,062 | 11/1927 | Halliburton | 259/151 |
| 1,962,642 | 6/1934 | Haines | 259/10 |
| 3,181,840 | 5/1965 | Rietz | 259/9 |
| 3,268,214 | 8/1966 | Higgs | 259/10 |
| 3,297,305 | 1/1967 | Walden | 259/4 |
| 3,339,899 | 9/1967 | Kauffman | 259/151 |
| 3,387,829 | 6/1968 | NanGoth | 259/161 |
| 3,456,599 | 7/1969 | Baker | 259/10 |
| 3,682,448 | 8/1972 | Kedzior et al. | 259/148 |
| 3,734,471 | 5/1973 | Engels | 259/10 |
| 3,762,691 | 10/1973 | Troy | 259/151 |
| 3,779,520 | 12/1973 | Edwards | 259/151 |

FOREIGN PATENT DOCUMENTS

| | | | |
|---|---|---|---|
| 647,993 | 10/1962 | Italy | 259/10 |

*Primary Examiner*—Harvey C. Hornsby
*Assistant Examiner*—Timothy F. Simone
*Attorney, Agent, or Firm*—Burd, Braddock & Bartz

[57] ABSTRACT

A system for the preparation of no-bake foundry sands for preparation of metal casting molds. A settable binder is introduced into the sand and thoroughly and uniformly mixed therewith and then discharged around a pattern. The resulting mold then sets up and hardens rapidly without baking. After use to produce a metal casting, the mold is broken up and the sand recycled for further use. The present system is characterized by ease of feed rate variation, coordinated feeding of components, short residence time, efficient mixing and reduced clean-up problems. It comprises a horizontal axis paddle-type rotary mixer, coordinated means for feeding the mixture components to the mixer housing and discharge of the mixture upon demand including at least one gas assisted injection port or nozzle for the binder system and control means for regulating the rates of flow. The apparatus is desirably movably supported to facilitate distribution of the discharge.

10 Claims, 5 Drawing Figures

FOUNDRY MIXER SYSTEM WITH GAS ASSISTED RESIN INJECTION

This application is a continuation-in-part of our copending application Ser. No. 337,564 for MIXER SYSTEM filed Mar. 2, 1973 now abandoned.

This invention relates to a system for thoroughly and uniformly mixing foundry sand with a settable binder for use in no-bake molding utilizing gas assisted injection of the binder system to facilitate and insure uniform distribution of the binder system. As pointed out in our aforesaid copending application Ser. No. 337,564, a recent advance in foundry practice has been the advent of binders which permit the production of foundry molds and cores for use in metal casting which do not require baking. Elimination of the necessity for baking molds has produced a number of advantages including higher production rates, flaskless molds and lower operating costs which make practice of no-bake molding attractive to the foundry industry. However, a number of drawbacks have hindered wider adoption of no-bake molding practices. Principally these drawbacks have included difficulty in thorough uniform mixing of the sand and binder, difficulty in proportioning of binder and sand and maintaining the proportions constant, difficulty in varying feed rates of binder and sand, difficult apparatus clean-up problems due to curing of the binder in the mixer when subjected to long residence time, and the like. The principal object of the present invention is to provide an improved system alleviating these problems of the prior art so as to encourage broader adoption of no-bake molding practices by foundries.

The mixing system, according to the present invention, is characterized by the use of a horizontal axis paddle type rotary mixer. Upon demand, feed materials, sand, and binder components, are introduced to one end of the rotary mixer in predetermined proportions, and the materials are quickly admixed uniformly and thoroughly and discharged from the opposite end of the mixer with minimum residence time. The mixer is provided with one or more gas assisted injection ports or nozzles to disperse and distribute the binder system components as they are introduced into the mixer housing for admixture with the sand. Operation of the mixer is continuous. Introduction of the feed materials is upon demand. Feed rates may be varied according to particular needs. Clean-up problems are minimized. The mixer is desirably mounted so as to be movable relative to the mold pattern for distribution of the sand mix over the pattern.

This mixing system is extremely versatile and permits a number of operating advantages. It permits variable delivery rates of the sand-binder mixture. It permits variable binder-to-sand ratios. This enables the operator to use a higher proportion of binder at the surface of the mold so as to produce a smoother molding surface and then cutting back on the proportion of binder used with the remainder of the mixture used to back up the molding surface and fill up the flask. The system permits variation of the catalyst-to-resin ratio to enable the operator to control the setting rate of the resin-sand mixture. Optionally, means may be also provided for the introduction of additives, such as iron oxide, to the mold facing sand to improve the casting surface.

The invention is illustrated in the accompanying drawings in which the same numerals identify corresponding parts and in which.

Figure 1:
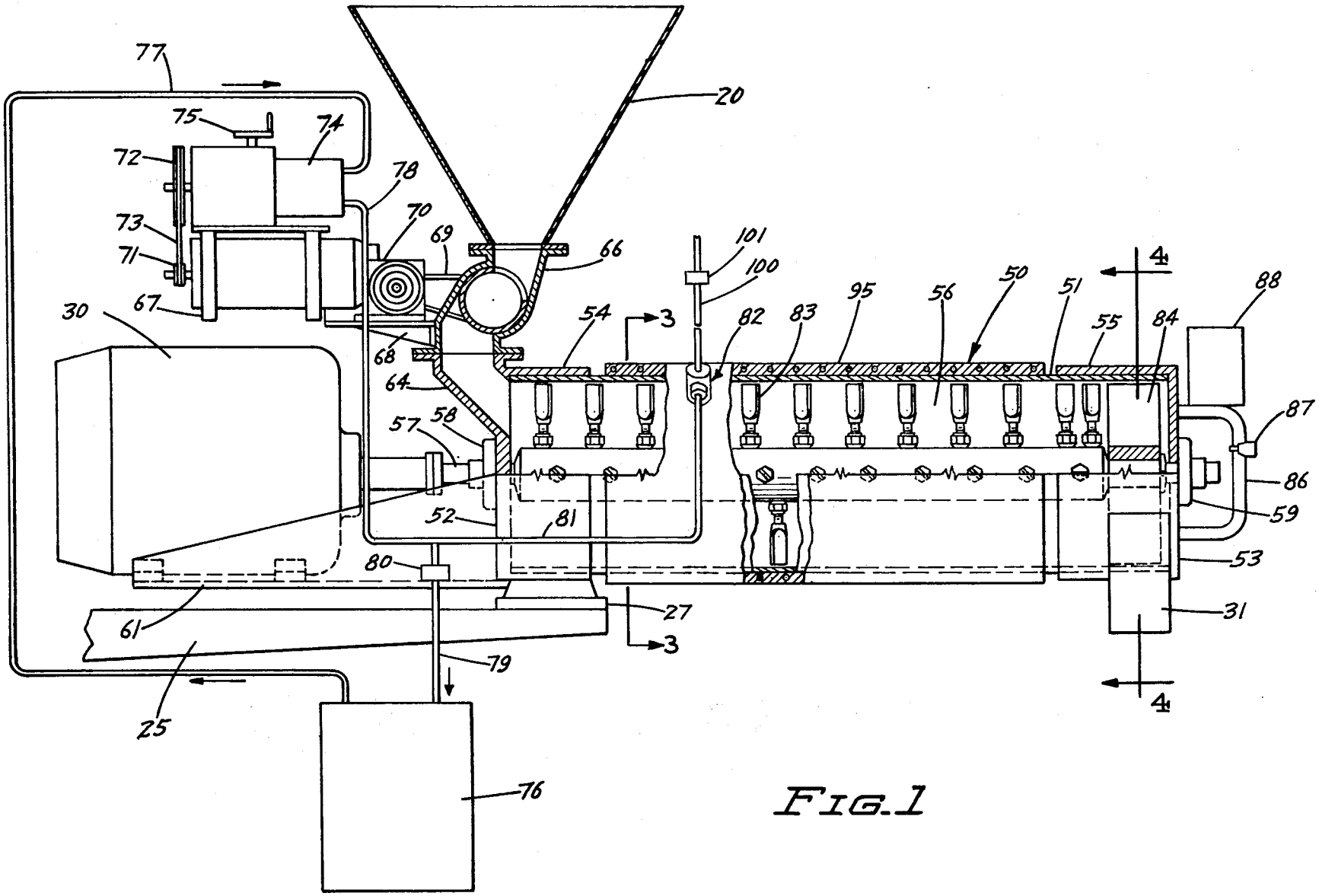
FIG. 1 is a side elevation, partly broken away and in section to reveal internal construction, and showing one specific form of mixer which may be used in the mixing system utilizing a gas assisted injection port according to the present invention.

Referring now to the drawings, and particularly to FIGS. 1 through 4, there is shown in detail one exemplary form of mixing system utilizing a preferred form of mixer which includes a mixer housing indicated generally at 50 and including a generally cylindrical open ended tubular liner 51 enclosed between an upstream end plate 52 and a downstream end plate 53. End plates 52 and 53 are attached to sleeves 54 and 55, respectively, which receive the opposite ends of liner 51 to enclose a mixing chamber 56.

An elongated shaft 57 extends through the end plates and chamber 56, being journaled for rotation within the chamber on a generally horizontal axis, and being supported in suitable bearing structures 58 and 59, mounted on the end plates 52 and 53, respectively. The upstream end of shaft 57 is coupled to the drive shaft of motor 30 which is cradled in a motor mount 61 secured to and carried by end plate 52. The housing 50, along with the attached motor 30, is mounted on a pivotal support 27 which in turn is supported by a cantilevered articulated arm or beam 25 or other base or support, either stationary or mobile, dependent upon the particular foundry environment in which the mixing system is to be used.

The upstream end of the mixer is provided with a material inlet 64 communicating through end wall 52 with mixing chamber 56. Foundry sand, which may be new or recycled sand or a mixture, is stored in a bin or other storage means (not shown). Sand from storage is introduced periodically into sand hopper 20 to maintain a supply of sand therein at all times. The sand hopper 20 and valve means, such as rotary pocket feeder 66, are mounted over material inlet 64. Alternatively, a slide gate valve screw feeder, belt feeder, or the like may be used. A variable speed motor 67 is supported on a further motor mount 68 which is supported from feeder unit 66. Feeder unit 66 is operatively connected by means of power transmission belt 69 or similar power transmission means, through electrically actuated clutch 70, to motor 67. Upon actuation by the operator, as hereinafter more fully described, clutch 70 is engaged to operate the feeder 66 and introduce sand through material inlet 64 into the mixing chamber 56.

Variable speed motor 67 is also operatively connected, as by means of drive sheaves 71 and 72 and belt 73, or equivalent drive means, to one or more positive variable displacement pumps 74, as needed. Displacement capacity of pumps 74 can be varied, as by means of adjustment control knob 75. Each pump 74 is connected to a resin and/or acid catalyst tank 76 through a suction line 77 and discharge line 78-79. A solenoid valve 80 controls circulatory flow from tank 76 through pump 74 and return. Discharge line 78-79 in intercepted by an injection line 81 communicating with a gas assisted injection port or nozzle 82 in the housing wall, as described in greater detail hereinafter. When solenoid valve 80 is closed by the operator, circulation of resin and catalyst is interrupted and pressure buildup occurs in discharge line 78 sufficient to spray the resin and catalyst into the sand introduced through inlet 64, assisted by a flow of air or other gas under moderate pressure.

Although a circulating system is shown, under some circumstances the binder components are not circulated. Instead, they are supplied directly to the mixer under pump pressure with feed upon demand controlled by appropriate valve means. The mixer system as illustrated is shown with one binder supply tank and flow line. It is to be understood, however, that in many circumstances in which two and three component systems are utilized the components are maintained in separate supply tanks and circulated through separate flow lines to separate injection ports for combination within the mixer. "Binder" or "binder system" are used throughout to define the settable mixture of components which holds the sand together, i.e., resin plus catalyst, or similar mixtures of a material capable of setting up and a material for initiating or accelerating setting.

Rotor shaft 57 carries a plurality of flat-faced mixing paddles 83 along its length. An optional slinger unit comprised of a plurality of flat rectangular blades or plates 84 radiating from the shaft is desirably provided at the discharge end of the mixing chamber to positively and forcefully discharge the resin-sand mixture from the mixing chamber through material discharge 31.

A pair of handles 86 are provided on the outside of end wall 53 of the mixer housing to enable an operator to move the mixer on its pivotal support 27 so as to maneuver the material discharge 85 relative to the pattern for more even distribution of the foundry sand and resin mixture over the pattern. Control buttons 87, desirably so-called "dead man controls", are provided on the handles 86 for actuating the switches controlling clutch 70 and solenoid valve 80 so that the apparatus is operable to discharge sand only when handles 86 are engaged by the hands of the operator.

A control panel 88 is desirably mounted on the end plate over handles 86. The control panel may include, for example, an on-off switch 89 for controlling the electric circuits energizing motors 30 and 67 and signal lights 90–92 to indicate to the operator the status of the several circuits. Desirably the control panel includes a selector knob and dial 93 to regulate through a silicon controlled rectifier drive the operating speed of variable speed motor 67 by which the feed rate of sand and binder are determined. The proportion of binder to sand is controlled by pump adjustment means 75.

The mixing chamber may optionally be enclosed within a temperature control jacket 95 for heating or cooling as required. Because of the abrasive nature of the sand being treated in the mixer, liner 51 is formed from tough abrasion-resistant steel and is designed to be readily replaceable.

Figure 2:
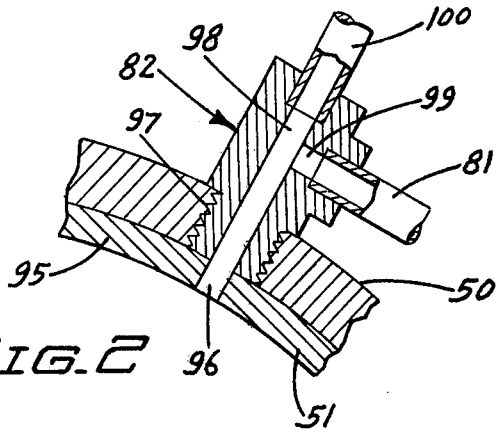
FIG. 2 is a fragmentary transverse vertical section on an enlarged scale showing one exemplary form of injection port in greater detail.

Referring now to FIG. 2, there is shown in detail one exemplary form of gas assisted binder system injection nozzle which may be utilized in the practice of the present invention. A port 96 is provided in mixer housing 51 in the upper portion thereof spaced downstream from the sand inlet by no more than about one mixer diameter. Nozzle 82 may be in the form of a fitting externally threaded at one end 97 and adapted to engage an internally threaded passage in communication with port 96. The fitting has a longitudinal passage 98 in communication with port 96 and a lateral or radial passage 99 intersecting passage 98. The resin binder supply line 81 engages and communicates with passage 99. A gas supply line 100 communicates with and engages passage 98. Gas supply line 100 is connected to a source (not shown) of gas under moderate pressure of between about 20 to 100 psi. FLow of gas through line 100 and into nozzle 82 is controlled by means of a simple on-off valve 101, which may, for example, be a solenoid valve actuated simultaneously with valve 80 controlling resin flow. Alternatively, a metering valve, such as a needle valve, may be installed in the gas line to continuously feed gas to the injection nozzle at a regulated rate. The gas may be air, or a neutral gas such as nitrogen, or a reactive gas such as a catalyzing gas, or the like. Other forms of injection nozzle may be used. For example, the nozzle may be a Y-fitting, or the lateral passage may be disposed to intersect the longitudinal passage at an oblique angle, or the longitudinal passage may be arcuate, or the like.

The flow of liquid from flow line 81 under pump pressure when valve 80 is closed is entrained in the jet of gas passing through channel 98. The liquid is atomized and dispersed through port 96 into the incoming sand which is in a highly dispersed state within the mixer housing as a result of the high speed agitating action of the rotor paddles. The intimate admixture of the dispersions of resin and sand and other components insures thorough uniform application of binder to the sand particles to insure uniform structure and high tensile strength in the resulting casting molds.

The number of pumps and tanks will depend upon the particular binder system employed. In the usual two component system utilizing a resin and catalyst for curing that resin, two pumps and two tanks will be employed. Resin and catalyst can be injected separately through use of a plurality of gas assisted injection nozzles 82, or the resin and catalyst may be combined prior to injection into the mixing chamber as in the illustrated embodiment. The system is adapted for use with all air-setting, gas-setting and thermo-setting binders. Most commonly used no-bake foundry binders include phenolic-urethane three component systems, oil-urethane two or three component systems, furan and furan/urea systems, sodium silicate systems, and others, all of which are commerically available.

Figure 3:
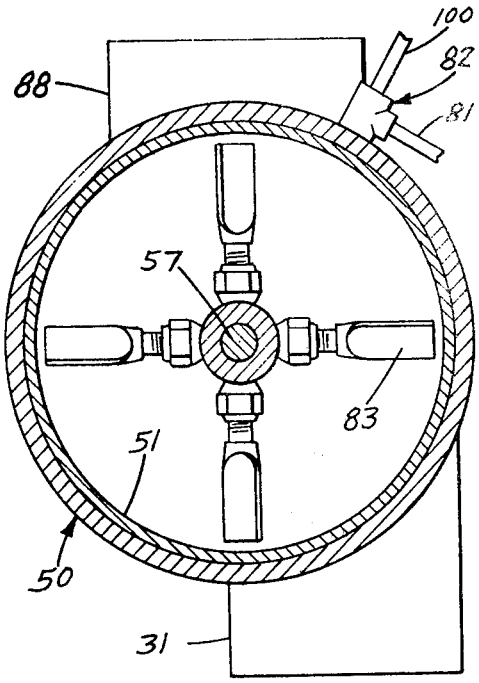
FIG. 3 is a transverse vertical section on the line 3—3 of FIG. 1 and in the direction of the arrows.
Figure 5:
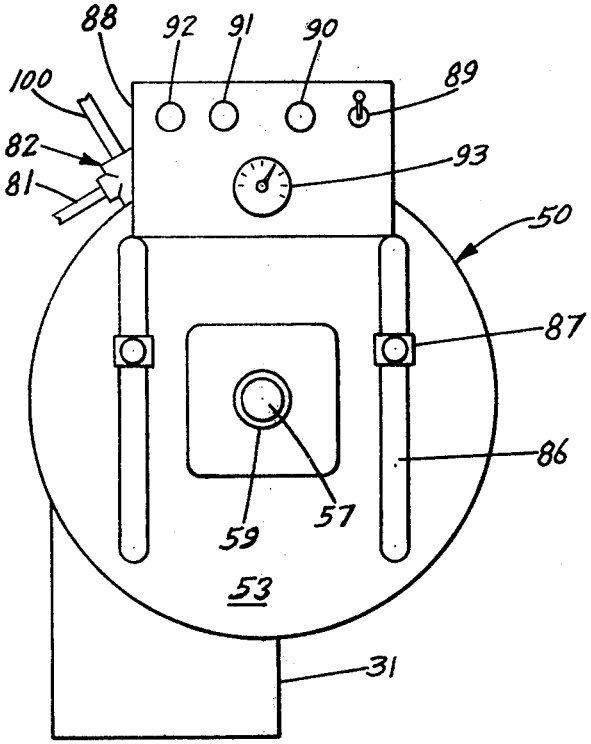
FIG. 5 is an end elevation of the mixer.
Figure 4:
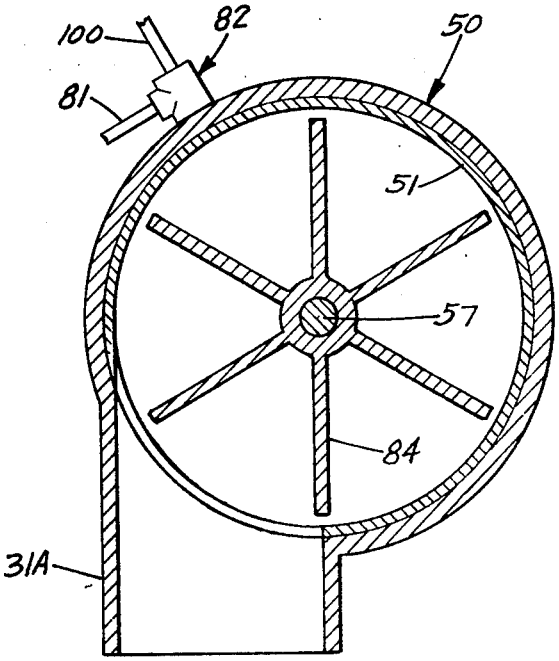
FIG. 4 is a transverse vertical section on the line 4—4 of FIG. 1 and in the direction of the arrows.

As best seen in FIG. 3, the paddles on rotor 57 are arranged in a plurality of rows distributed about the shaft, the rows being disposed either linearly or spirally about the shaft. The paddles in each successive row are off-set slightly in the downstream direction relative to the preceding row in a spiral or helical pattern. The paddles are dispoed with their faces pitched at an angle relative to the axis of the shaft, the precise angle being dependent upon such variables as the number of paddles, the length of the housing, the desired residence time of the mixture, and the like. The paddles are mounted on radiating threaded shafts so as to permit radial adjustment and rotation of the paddles.

The paddles not only thoroughly and uniformly agitate and admix the sand and binder components but they advance the material through the housing. The paddle tips rotate in close proximity to the liner surface so as to minimize possible accumulation of the sand-resin mixture on the mixing chamber walls. For example, in a 6 inch diameter housing the clearance between the tip of the paddle and inside housing wall is from ½ inch or less to just short of touching the wall; for a 14 inch diameter housing the clearance is 1 inch or less; for a 20 inch diameter housing, it is 1½ inches or less.

In the normal operation of the mixing system described in connection with FIGS. 1 through 5, according to the present invention, motors 30 and 67 run continuously to rotate the mixing paddles and continuously circulate the binder components. Gas may be permitted to bleed through nozzle 82 into the circulating binder mixture. A supply of binder components is maintained in tank 76 and a supply of sand is maintained in hopper 20. The apparatus is thus ready to deliver a constant supply of mixed sand on demand. The operator, having first selected the desired flow rate, grasps handles 86 and actuates controls 87. Clutch 70 is engaged to operate feeder 66 and simultaneously solenoid valves 80 and 101 are energized to open the binder and gas flow lines and inject the finely dispersed binder system components into the mixer. Both sand and resin are immediately caught up and vigorously agitated and intermixed by rotating paddles 83 and rapidly advanced through the mixing chamber, finally being discharged by slinger blades 84 through discharge duct 31. Typical residence times of the sand in the mixing chamber range from only about a mere 1 to 5 seconds. As the sand is being discharged, the operator maneuvers the end of the mixer and sand discharge 85 relative to the pattern for the mold being produced. Upon release of pressure from the controls 87, clutch 70 is disengaged and solenoid valves 80 and 101 are de-energized to immediately stop the feeding of material into the inlet end of the mixer. Paddles 83 and blades 84 continue to rotate quickly emptying the mixing chamber of the sand mixture. Clean-up problems are minimized. Because the mixer always empties completely, or nearly so, at the end of each cycle, little or no reacted mixture remains in the mixer. This eliminates the need to run clean sand through the mixer whenever shutting down for extended periods of time, thus eliminating a major cause of sand waste. The intense uniform mixing action permits a marked reduction in the amount of binder and/or catalyst needed for a given tensile strength resulting in material savings to the user.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. An apparatus for thoroughly and uniformly mixing foundry sand and catalyst-curable resinous binder therefor and quickly discharging with minimum residence time and comprising a multiple paddle mixer rotor enclosed within a housing, power means for continuously operating the rotor, material inlet means adjacent one end of the housing and mix discharge means at the other, and material storage containers for each of the materials to be mixed, said apparatus characterized by:

(A) said mixer housing comprising an elongated horizontal cylindrical tube closed at both ends;

(B) first positive feed means for introducing sand from the storage container therefor to a sand inlet at one end of the housing, and power means for operating said first feed means on demand;

(C) separate positive feed means for simultaneously introducing liquid binder components from the storage container therefor to said housing downstream from said sand inlet, said separate feed means comprising:

(1) power pump means for transporting said binder components in at least one flow line from the storage container therefor to said mixer housing, (2) at least one injection nozzle disposed on said housing downstream from said sand inlet and connected to said binder component flow line, (3) valve means in said binder component flow line, (4) a gas line in communication with said nozzle and adapted for connection to a source of gas under pressure, and (5) means for actuating said valve on demand to direct flow of binder components to said nozzle and into the flow of gas to said nozzle;

(D) controls for actuation of said feed means mounted adjacent the discharge end of the mixer housing;

(E) said mixer rotor comprising a shaft journaled for rapid rotation on a central horizontal axis within said housing, with a plurality of variable pitch paddles disposed to extend radially from said shaft and rotate with their tips in close proximity to the housing wall to mininize accumulation of sand-resin mixture on the housing walls, whereby said sand is dispersed and said binder is dispersed and injected therein and the sand and binder are quickly and uniformly mixed in the housing and quickly discharged therefrom with a residence time within the housing of from about 1 to 5 seconds.

2. Apparatus according to claim 1 further characterized in that said injection nozzle is disposed on the upper portion thereof downstream from said sand inlet by a distance no greater than about one diameter of said mixer housing.

3. Apparatus according to claim 1 further characterized in that said injection nozzle comprises a fitting adapted for attachment to said mixer housing through the housing wall, said fitting having a longitudinal passage therethrough, means for connecting said passage to a source of gas under pressure, a lateral passage communicating with said longitudinal passage and means for connecting said lateral passage to said binder component flow line.

4. Apparatus according to claim 1 further characterized in that a further valve is disposed to control flow through said gas line, and said means for actuating said valve in said binder flow line simultaneously actuates said further valve in said gas line.

5. Apparatus according to claim 4 further characterized in that said valves in said binder component flow line and in said gas line are solenoid valves connected to said control means for simultaneous operation on demand.

6. Apparatus according to claim 1 further characterized in that the housing is enclosed at least in part by a temperature control jacket to control the temperature of the reaction between the binder components.

7. Apparatus according to claim 1 further characterized in that said power pump means and binder component flow line are disposed to circulate the binder components from the storage container therefor and return.

8. A method for treating foundry sand for mold production which comprises:

(A) continuously rapidly rotating a multiple paddle mixer rotor in an elongated horizontal axis tubular-cylindrical mixing chamber, the paddle tips rotating in close proximity to the walls thereof to minimize accumulation of sand-resin mixture thereon;

(B) continuously maintaining components of liquid binder for said sand under pump pressure in at least one flow line;

(C) introducing foundry sand upon demand to one end of the mixing chamber and dispersing said sand therein by action of said continuously rotating rotor;

(D) simultaneously engaging said binder component flow line and introducing said binder components to said chamber upon demand along with an entraining flow of gas under pressure to inject said binder components in dispersed form into said already dispersed sand at the same end of the mixing chamber downstream from the point of introduction of the sand;

(E) vigorously agitating the sand and binder with the rotor paddles to admix the same;

(F) simultaneously rapidly advancing the sand and binder to the opposite end of the chamber and discharging the same, the residence time of said sand and binder in said chamber being from about 1 to 5 seconds;

(G) discontinuing introduction of sand and binder components into the mixing chamber; and (H) continuing rotation of the mixer rotor to rapidly discharge remaining sand and binder from the chamber.

9. A method according to claim 8 further characterized in that said gas is introduced into said mixing chamber under moderate pressure from between about 20 to 100 psi.

10. A method according to claim 8 further characterized in that said binder components are continuously circulated from the storage container therefor and return until introduced into the mixing chamber.

* * * * *

UNITED STATES PATENT AND TRADEMARK OFFICE

CERTIFICATE OF CORRECTION

PATENT NO. : 4,126,398

DATED : November 21, 1978

INVENTOR(S) : David L. Phillips et al

It is certified that error appears in the above–identified patent and that said Letters Patent are hereby corrected as shown below:

Column 2, line 65, "in" should be --is--.

Column 4, line 53, "dispoed" should be --disposed--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*